US005975241A

United States Patent [19]

Berish et al.

[11] Patent Number: 5,975,241

[45] Date of Patent: Nov. 2, 1999

[54] PUMP JACK HANDLE ASSEMBLY

[75] Inventors: Robert P. Berish, Sharon; Steven J. Ford, Avon, both of Mass.

[73] Assignee: Quality Steel Products, Inc., Stoughton, Mass.

[21] Appl. No.: 09/007,162

[22] Filed: Jan. 14, 1998

[51] Int. Cl.[6] ..... A63B 27/00

[52] U.S. Cl. ..... 182/136; 248/243

[58] Field of Search ..... 182/133, 136; 248/243, 246

[56] References Cited

U.S. PATENT DOCUMENTS

| | | | |
|---|---|---|---|
| 4,463,828 | 8/1984 | Anderson | 182/136 |
| 4,597,471 | 7/1986 | Anderson | 182/136 |
| 4,942,941 | 7/1990 | Anderson | 182/136 |
| 4,955,584 | 9/1990 | Anderson | 182/133 |

*Primary Examiner*—Alvin Chin-Shue

*Attorney, Agent, or Firm*—Pandiscio & Pandiscio

[57] ABSTRACT

A handle assembly is provided for a pump jack having a shackle assembly with a rotatable pole-gripping rod for engaging and rolling along a pole surface. The handle assembly includes an extension of the pole-gripping rod, a coil spring disposed on the rod extension, a sleeve disposed around the rod extension and coil spring, and a bar fixed to the sleeve. A crank arm extends transversely of the rod extension which is pivotally connected to the arm at a first pivot location. The bar is pivotally connected to the arm at a second pivot location. The coil spring urges the sleeve into engagement with a locking member on the shackle assembly, such that the sleeve is prevented from rotating and the rod is unable to roll along the surface of the pole. A handle is mounted on the free end of the crank arm. The coil spring is further operative to hold arm in a position in which rotation thereof is blocked by a frame member of the jack, whereby to further prevent the rod from rotating and rolling along the surface of the pole.

18 Claims, 7 Drawing Sheets

PUMP JACK HANDLE ASSEMBLY

BACKGROUND OF THE INVENTION

1. Field of the Invention

The invention relates to pump jacks for traveling up and down scaffolding poles, and is directed more particularly to a handle assembly which prevents accidental sliding of the pump jack down a pole.

2. Description of the Prior Art

It is known to use pump jacks in scaffolding systems for raising and lowing scaffolding platforms. Typically, a number of pump jack poles are secured in spaced relationship to a building or other edifice to be worked on, and pump jacks are utilized to carry the scaffolding platforms up and down the poles. Scaffolding staging or platforms are extended across support arms provided on the pump jacks. Workers stand on the scaffolding platforms and operate the pump jacks to move the platforms up and down along the pump jack poles.

Each pump jack typically includes a frame with an upper and a lower shackle. A pump arm is pivotally connected to the frame to operate the two shackles alternately. The operation causes the upper shackle to grip the pole permitting the frame to step upward along the pole. Thereafter, the lower shackle grips the pole and the upper shackle steps up to a next position on the pole. In this manner, one of the shackles steps up the pole while the other shackle grips the pole. Pump jacks are shown and described in U.S. Pat. No. 4,597,471, issued Jul. 1, 1986 and U.S. Pat. No. 4,955,584 issued Sep. 11, 1990.

The upper shackle includes a rod which can be applied engaged with the pole to grip the pole. A crank handle coupled to the rod permits winding and unwinding of the rod. To lower the pump jack, a release lever releases the lower shackle from engagement with the pole. The crank handle is then operated to unwind the rod, thereby rolling the pump jack down the pole. In order to prevent accidental unwinding of the crank handle, the handle may be provided with a safety locking position in which the handle is disposed inwardly of the pump jack frame so as to be retained in place by the pump jack frame, which blocks the handle to prevent accidental unwinding of the rod. A pump jack of the aforedescribed construction has been disclosed in U.S. Pat. No. 4,463,824, issued Aug. 7, 1984, and U.S. Pat. No. 4,942,941 issued Jul. 4, 1990.

One of the most critical concerns when using pump jacks is the safety of the workers standing on the staging supported by the pump jacks. Despite the presence of safety locking handles, which should be positioned inwardly to prevent accidental unwinding, accidental slipping of the pump jack down the pole has occurred when workers have forgotten to move the handle into the safety position. In U.S. Pat. No. 4,463,824, there is provided a crank handle assembly wherein the handle is movable to a safety locking position in which the handle is held in place by the pump jack pole and thereby prevents accidental unwinding of the rod, and thereby avoids the pump jack accidentally slipping down the pole. The handle is positionable in either of two positions. In a first position, an arm connected to the rod extends downwardly and a handle portion connected to the arm extends inwardly in position to engage the front surface of the pole, to prevent unwinding of the rod. In a second position, the arm extends upwardly and the handle extends outwardly in a cranking position. Thus, to change the handle assembly from the safety (first) position, to the crank (second) position it is necessary that the handle be grasped while locked against the pole, pulled outwardly and then upwardly. To change the handle back to the safety position, the handle must be pulled outwardly, downwardly and inwardly and up against the pole surface. It is deemed beneficial to have available a handle assembly which is more easily and simply movable between safety and crank positions.

In U.S. Pat. No. 4,942,941 there is provided a handle assembly having a safety and crank feature substantially as taught by the '824 patent, and, in addition, is provided with an anti-spin feature at the end of the rod opposite from the handle assembly end. The anti-spin feature comprises a rubber disc which can be pressed against an end of the rod by tightening down on an external bolt. While the rubber disc exercises some restraint on rotation of the rod, it is desirable to have a more positive locking means which would operate to stop rotation of the rod, as opposed to merely slowing or damping rotation. It is further desirable to have a locking means which is operative without the necessity of tightening a bolt, an exercise which could be problematic in an emergency situation.

3. Summary of the Invention

An object of the invention is, therefore, to provide a novel pump jack handle assembly having a safety position in which turning of the handle assembly is blocked by a frame portion of the pump jack.

A further object of the invention is to provide such a novel handle assembly which is spring-biased toward a safety position.

A still further object of the invention is to provide such a handle assembly as may be moved through a short distance in one direction to reach a crank position and which, upon release is adapted to snap back to a safety position.

A still further object of the invention is to provide such a handle assembly having a second safety feature, operable in the aforementioned safety position, which interlocks the rod with a rod mounting to prevent rotation of the rod in the mounting.

Another object is to provide a pump jack with a novel handle assembly for rotating a pole-gripping rod of a shackle assembly, said handle assembly having a locking member that is movable by the handle assembly into interlocking engagement with a portion of the jack, whereby the handle assembly is prevented from rotating said pole-gripping rod.

With the above and other objects in view, as will herewith appear, a feature of the present invention is the provision of a handle assembly for a pump jack having a shackle including a yoke with opposed side plates rotatably mounting a rod spanning the side plates and engageable with a pump jack pole and for rolling along a surface of the pole during descent of the pump jack along the pole. The handle assembly comprises an extension of the rod extending outwardly from one of the side plates, a free end of the rod extension being spaced from the one side plate. A coil spring is disposed around the rod extension. A sleeve is disposed around the rod extension and around the coil spring, a first end of the sleeve being opposed to the one side plate and a second end of the sleeve facing outwardly from the one side plate. A bar is fixed to the sleeve and extends lengthwise thereof with a free end extending beyond the second end of the sleeve. An arm extends transversely of the rod extension, the rod extension free end being pivotally connected to the arm at a first location proximate a first end of the arm, and the bar free end being pivotally connected to the arm at a second location proximate the first end of the arm and spaced from the first location in a direction toward a free end of the arm. The coil spring urges the arm first end outwardly from the yoke, causing the bar to move inwardly toward the yoke, to urge the sleeve first end toward the yoke. A projection extends outwardly from the one side plate and is engageable by the sleeve first end, the projection and the sleeve first end being configured such that the engagement of the sleeve first end and the projection serves to interlock the sleeve and the projection such that the sleeve is prevented from rotating, and the handle is prevented from rotating, and thereby the rod, such that the rod is fixed and unable to roll along the surface of the pole.

In accordance with a further feature of the invention, there is provided a handle assembly for a pump jack having a shackle including a yoke with opposed side plates rotatably mounting a rod spanning the side plates and engageable with a pump jack pole and for rolling along a surface of the pole during descent of the pump jack along the pole. The handle assembly comprises an extension of the rod extending outwardly from one of the side plates, a free end of the rod extension being spaced from the one side plate. A coil spring is disposed around the rod extension. A sleeve is disposed around the rod extension and around the coil spring, a first end of the sleeve being opposed to the one side plate and a second end of the sleeve facing outwardly from the one side plate. A bar is fixed to the sleeve and extends lengthwise thereof with a free end extending beyond the second end of the sleeve. An arm extends transversely of the rod extension, the rod extension free end being pivotally connected to the arm at a first location proximate a first end of the arm, and the bar free end is pivotally connected to the arm at a second location proximate the first end the arm and spaced from the first location in a direction toward a free end of the arm, and a handle is mounted on the free end of the arm. A spring is operative to pivot the arm about the first and second locations to urge the arm free end, and thereby the handle, in a direction toward the yoke and aligned with a frame member supporting the shackle and which blocks rotational movement of the arm and the handle, and thereby the rod, to further prevent the rod from rolling along the surface of the pole.

In accordance with a still further feature of the invention, there is provided a handle assembly for a pump jack having a shackle including a yoke with opposed side plates rotatably mounting a rod spanning the side plates and engageable with a pump jack pole for rolling along a surface of the pole during descent of the pump jack along the pole. The handle assembly comprises an extension of the rod extending outwardly from one of the side plates, a free end of the rod extension being spaced from the one side plate. A coil spring is disposed around the rod extension. A sleeve is disposed around the rod extension and around the coil spring, a first end of the sleeve being opposed to the one side plate and a second end of the sleeve facing outwardly from the one side plate. A bar is fixed to the sleeve and extends lengthwise thereof with a free end extending beyond the second end of the sleeve. An arm extends transversely of the rod extension, the rod extension free end being pivotally connected to the arm at a first location proximate a first end of the arm, and the bar free end being pivotally connected to the arm at a second location proximate the first end of the arm and spaced from the first location in a direction toward a free end of the arm. A handle is mounted on the free end of the arm.

The coil spring urges the arm first end outwardly from the yoke, causing the bar to move inwardly toward the yoke, to urge the sleeve first end toward the yoke. A projection extends outwardly from the one side plate and is engageable by the sleeve first end, the projection and the sleeve first end being configured such that the engagement of the sleeve first end and the projection serves to interlock the sleeve and the projection such that the sleeve is prevented from rotating, and the handle is prevented from rotating, and thereby the rod, such that the rod is fixed and unable to roll along the surface of the pole. The spring is operative to pivot the arm about the first and second locations to urge the arm free end and thereby the handle in a direction toward the yoke and aligned with a frame member supporting the shackle and which blocks rotational movement of the arm and the handle, and thereby the rod, to further prevent the rod from rolling along the surface of the pole.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
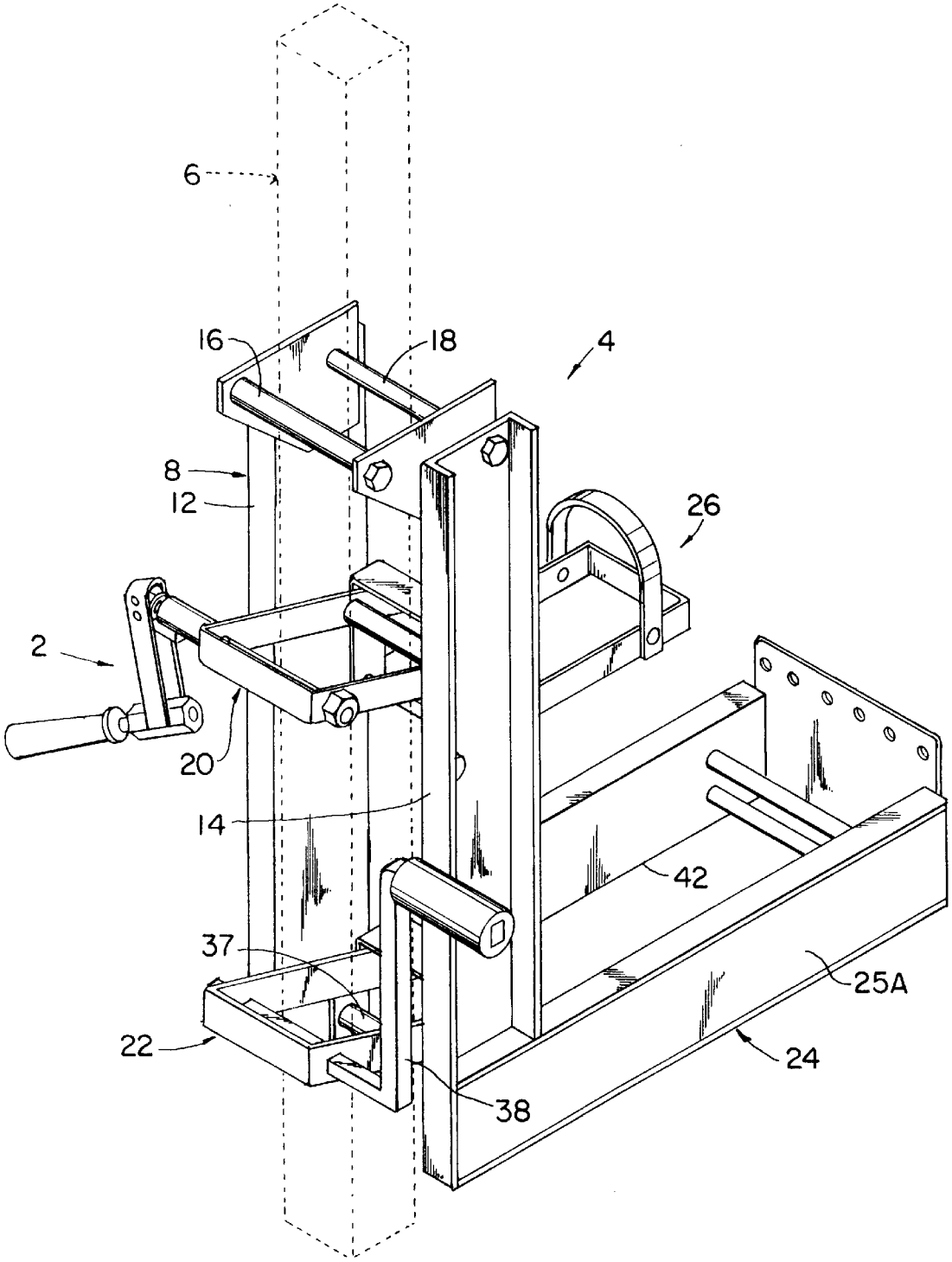
FIG. 1 is a perspective view of one form of handle assembly shown in conjunction with a pump jack and illustrative of an embodiment of the invention.

Referring to FIG. 1, it will be seen that the illustrative handle assembly 2 is used in conjunction with a pump jack 4 adapted for movement up and down a pole 6. The pump jack 4 includes a frame 8 which straddles the pole 6 and which includes two opposed frame members 12, 14. Spacing members, e.g., members 16 and 18, maintain a fixed spacing between the frame members 12 and 14.

The pump jack 4 further includes an upper shackle assembly 20 and a lower shackle assembly 22. Fixed to the lower ends of the frame members 12, 14 is a support arm assembly 24 extending in a direction normal to the frame members. A pump arm 26 coupled to the upper shackle assembly is operable so as to cause the two shackle assemblies to alternately grip and release the pole 6 so as to effect upward stepping of the pump jack along the pole, as is described in detail in the aforementioned patents.

Figure 2:
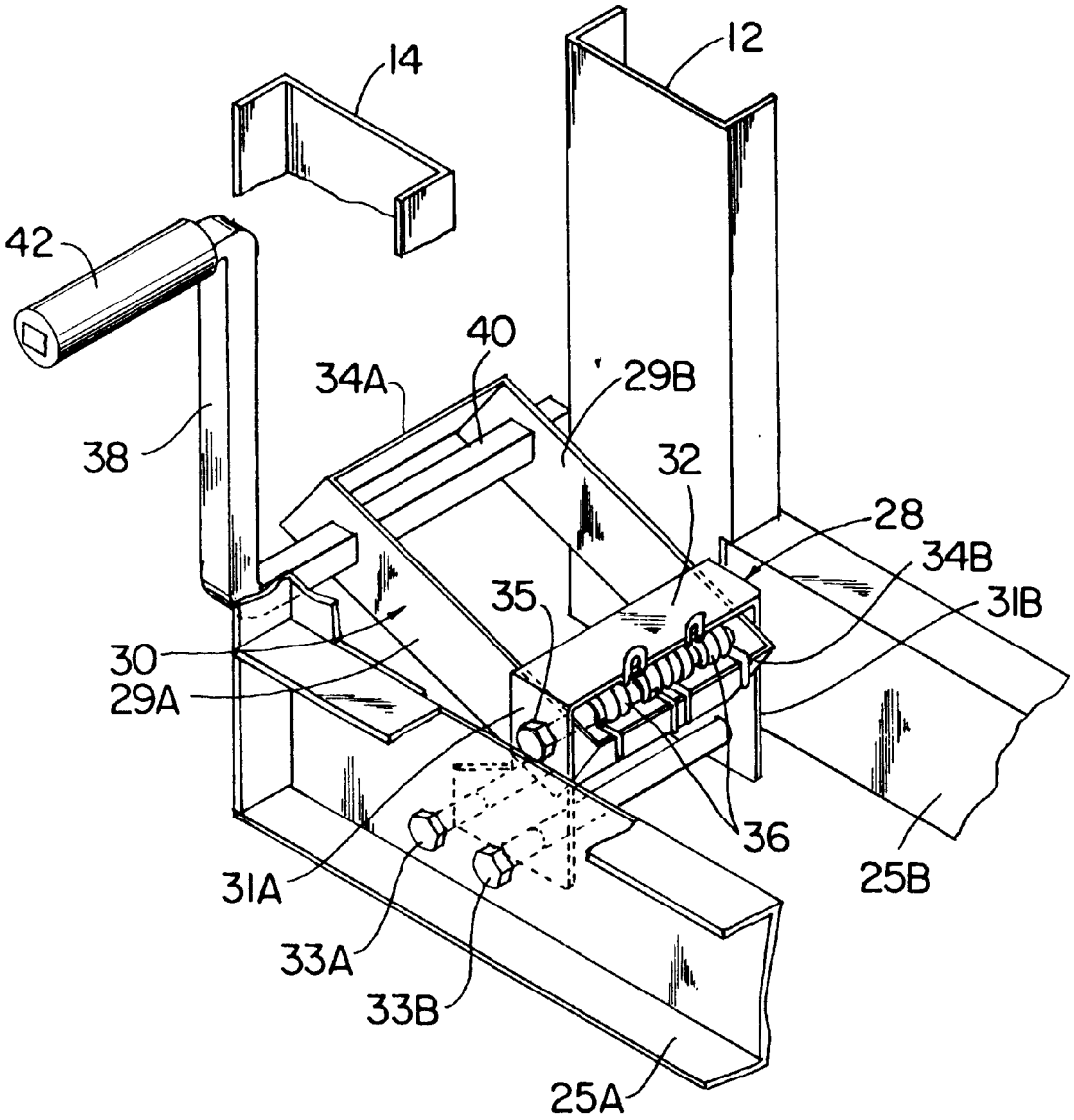
FIG. 2 is a perspective view of a lower shackle portion of the pump jack of FIG. 1.

The lower shackle assembly is constructed according to the prior art. As seen best in FIG. 2, it comprises a U-shaped linkage member 28 and a yoke member 30. Linkage member 28 has opposite legs 31A, 31B and a connecting bar 32. At the open end of linkage member 28 the two legs 31A, 31B are secured by shafts 33A, 33B to side members 25A, 25B of support arm assembly 24. Yoke member 30 is box shaped, having opposite side legs or plates, 29A, 29B and front and rear connecting bars 34A, 34B. Yoke member 30 is pivotally attached to linkage member 28 by a pivot shaft 35. A pair of springs 36 surround pivot shaft 35 and have their opposite ends engaged with connecting bars 32 and 34B. The springs bias the yoke member so as to oppose its pivotal movement counterclockwise (as viewed in FIG. 2) relative to linkage member 28.

A release lever 38 (FIGS. 1 and 2) forms part of the lower shackle assembly, preferably being an integral extension of the front pole-gripping bar 40 of that shackle assembly. Lever 38 carries a foot pedal 42 at its outer end. Lever 32 is operable by depressing foot pedal 42 to pivot yoke member 30 of the lower shackle assembly 22 counterclockwise (as viewed in FIGS. 1 and 2) so as to disengage the front pole-gripping bar 40 from pole 6, thereby permitting the pump jack to be lowered down the pole. A roller 37 (FIG. 1) on shaft 33A acts as the rear pole-gripping member for the lower shackle assembly.

The upper shackle assembly 20 (FIGS. 1 and 3) includes a yoke member 44 mounted between the two frame members 12, 14. Yoke member 44 includes two opposed legs or side plates 46A, 46B which straddle the pole 6 and are connected by front and rear connecting bars 48A, 48B respectively. A rear gripping rod assembly 50 extends between and is anchored to side plates 46A, 46B and includes a roller 51 for engaging pole 6.

Figure 3:
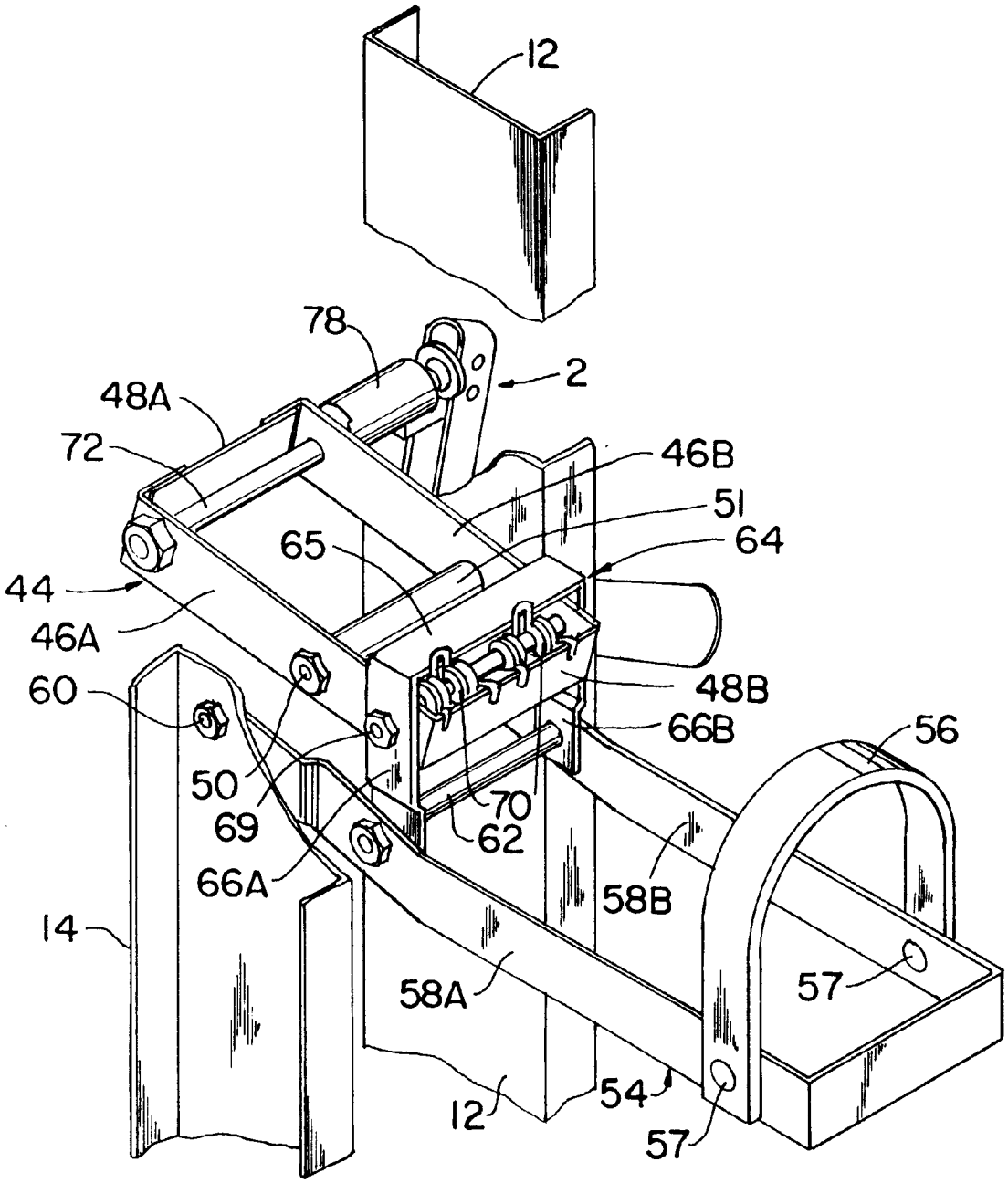
FIG. 3 is a perspective view of an upper shackle portion of the pump jack including the inventive handle assembly.

The pump arm 26 includes a generally U-shaped member 54 having a stirrup 56 made of a flexible material, e.g., rubber or leather, at its rearward end. An operator's foot typically is placed through the stirrup 56. The stirrup 56 is connected to the U-shaped member 54 by pivot pins 57. The forward ends of the opposite legs 58A, 58B of U-shaped member 54 are pivotally connected by separate pivot pins 60 to vertical frame members 12,14 (FIG. 3). An interconnecting rod 62 pivotally connects opposing legs 66A, 66B of a U-shaped linkage member 64 to the two legs 58A, 58B of U-shaped member 54. Yoke member 44 of upper shackle assembly 20 is pivotally connected to linkage member 64 by a connecting shaft 69. A pair of springs 70 are mounted on shaft 69 and have their ends engaged with connecting bar 65 of linkage member 64 and connecting bar 48B of yoke member 44, the springs acting to bias yoke member 44 against pivotal movement counterclockwise (as viewed in FIG. 3) relative to the linkage member.

The upper shackle assembly 20 further includes a rotatable rod 72 which grips the pole 6 oppositely the rear rod roller 51. The handle assembly 2 is coupled to rod 72 to permit rotation of the rod in a direction to cause controlled lowering of the pump jack down the pole upon release of the lower shackle by depressing foot pedal 42 (FIGS. 1 and 2), as fully described in the aforementioned patents. Also as explained in detail in said aforementioned patents, by pumping the pump arm 26, the pump jack 4 (and any plank or staging disposed on support arm assembly 24) is caused to ascend the pole in step-wise fashion, and that by pushing the foot pedal 42, and operating the handle assembly 2, the rod 72 is caused to roll down the pole 6, to lower the pump jack 4.

Figure 4:
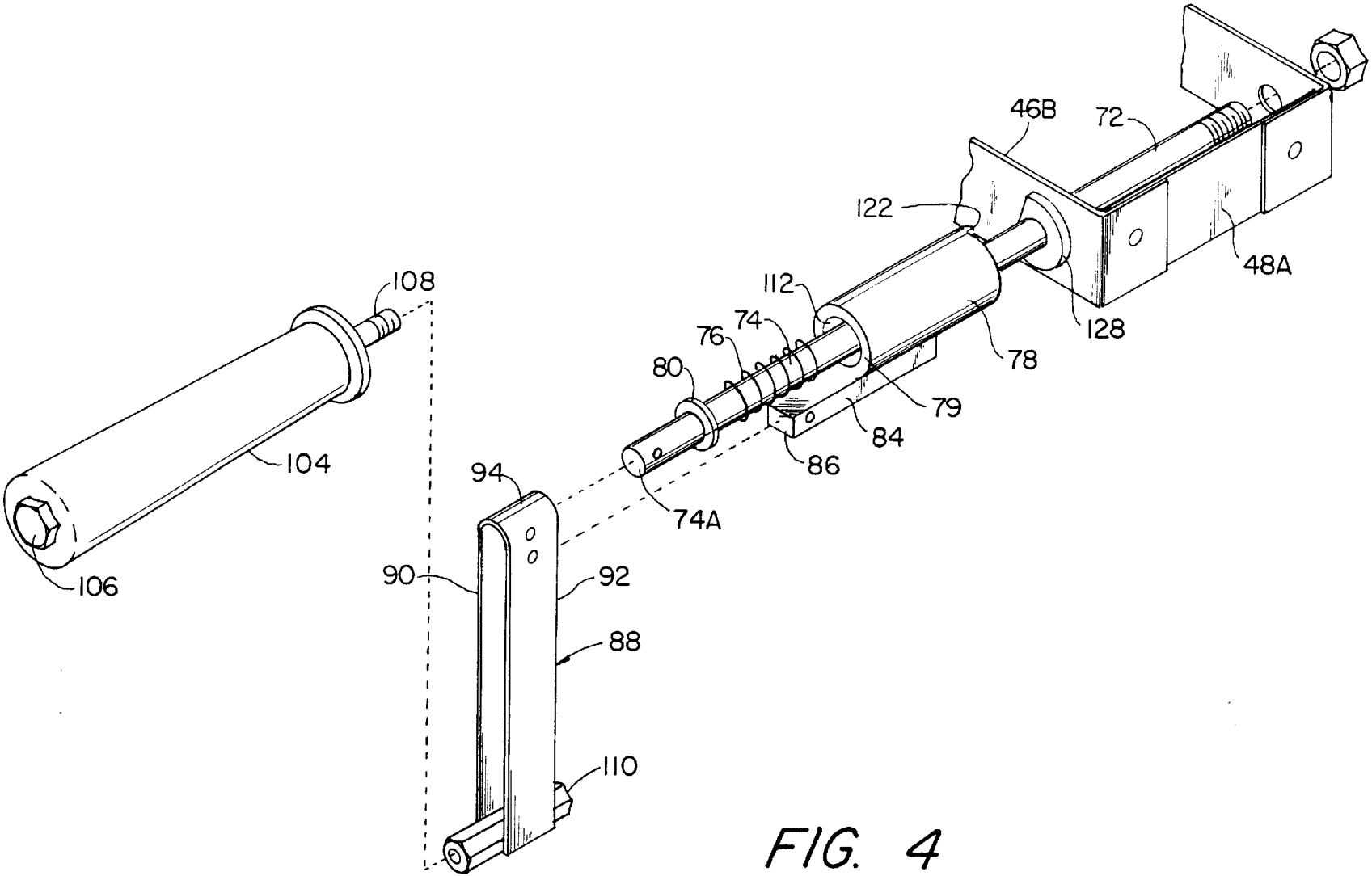
FIG. 4 is an exploded perspective view of the handle assembly of FIGS. 1 & 3.

Referring to FIG. 4, it will be seen that handle assembly 2 includes an extension 74 of rod 72, extending outwardly from the upper shackle yoke side plate 46B. A compression coil spring 76 surrounds rod extension 74. A cylindrical sleeve 78 is slidably mounted on rod extension 74 and coil spring 76 (see also Figs.. 5 and 6). A first end of sleeve 78 faces side plate 46B, while the opposite end of the sleeve 78 faces outwardly in a direction away from side plate 46B. A washer 80 is loosely mounted on the rod extension 74 at its free end 74A (FIG. 4). A bar 84 is fixed to the exterior of the sleeve 78 and extends lengthwise of the sleeve, with a free end 86 of the bar 84 extending beyond the corresponding end 79 of sleeve 78.

Figure 5:
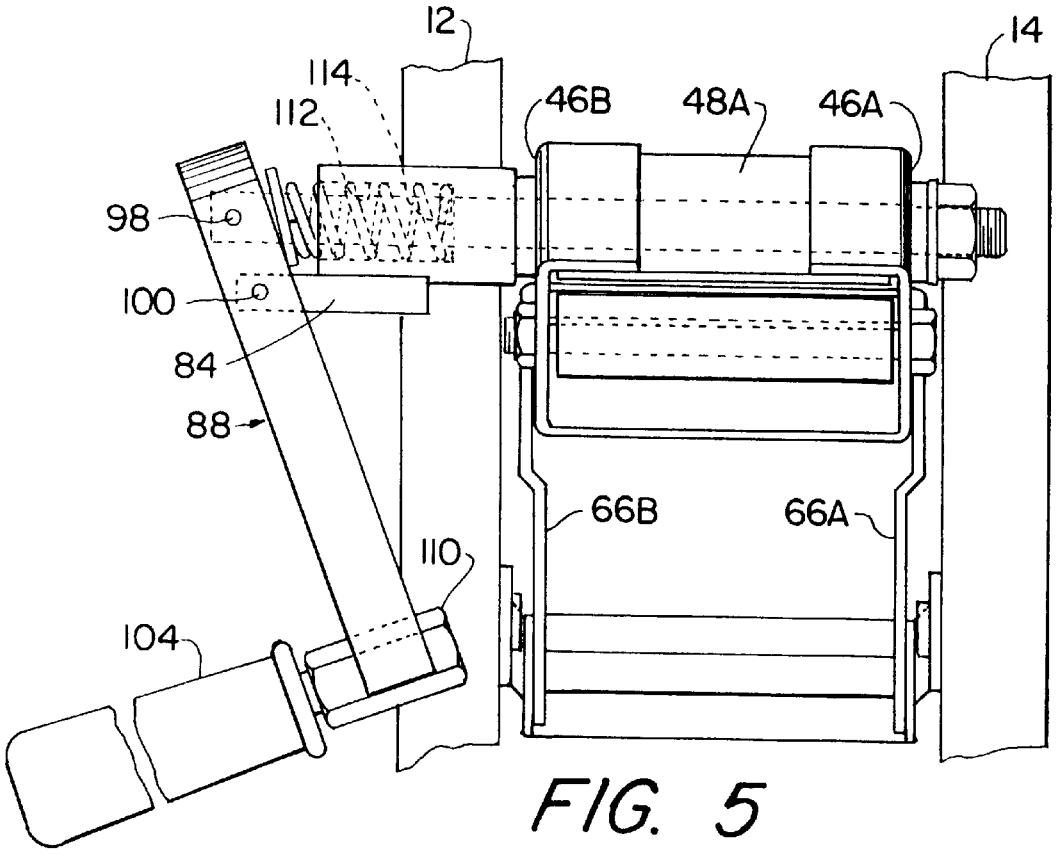
FIG. 5 is an elevational view of the handle assembly, shown in a non-rotatable position.
Figure 6:
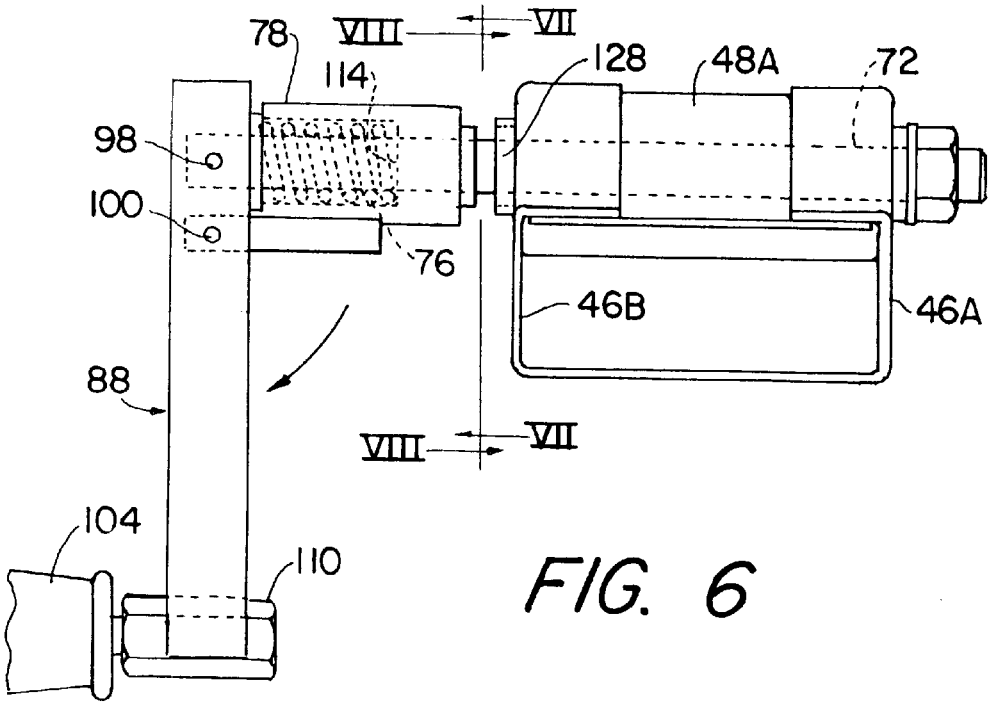
FIG. 6 is similar to FIG. 5, but showing the handle assembly in a rotatable position.

An arm 88 extends transversely of rod extension 74. Arm 88 is U-shaped, having parallel arm portions 90 and 92 and a curved connecting portion 94. The outer end of extension 74 is pivotally connected to arm portions 90, 92 at a first location adjacent connecting portion 94 by a pivot pin 98 (FIGS. 5 and 6). The free end 86 of bar 84 also extends between arm portions 90, 92 and is pivotally connected to them at a second location by a second pivot pin 100 (FIGS. 5, 6). A handle 104 surrounds and is rotatably retained by a shaft 106 that has a reduced diameter threaded extension 108. The latter is screwed into an elongated nut 110 that extends between and is fixed to arm portions 90, 92 away from curved section 94. Handle 104 serves as a grip member by which the rod extension 74 may be rotated to lower the jack on the pole, with lowering of the jack being characterized by the rotating rod 72 rolling down the pole.

Coil spring 76 is disposed in a counterbore 112 within sleeve 74, the counterbore 112 forming at one end an annular shoulder 114 against which one end of the coil spring is seated. The other end of counterbore 112 is open, permitting coil spring 76 to extend slightly out of the pocket into engagement with washer 80. Spring 76 urges sleeve 78 toward side plate 46B and simultaneously it urges washer 80 to engage the adjacent side portions 90 and 92 of arm 88 in the region of pivot pin 98. As a result, bar 84 exerts a pulling force on arm 88, urging it to pivot counterclockwise (FIGS. 5,6) so that the free (handle) end of arm 88 extends inwardly beyond the outer extension of frame member 12 (FIG. 5), in which position arm 88 is blocked by that frame member so as to prevent rotation of rod extension 74. This handle-blocking action prevents rod 72 from turning, and thereby prevents the pump jack from descending down the pole on which it is mounted.

Figure 7:
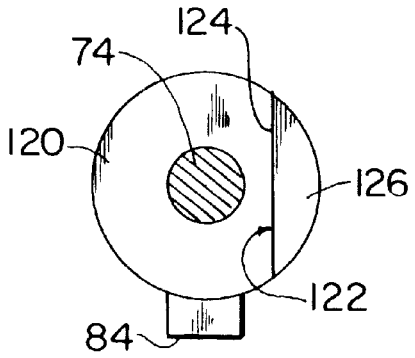
FIG. 7 is a sectional view taken along line VII—VII of FIG. 6.
Figure 8:
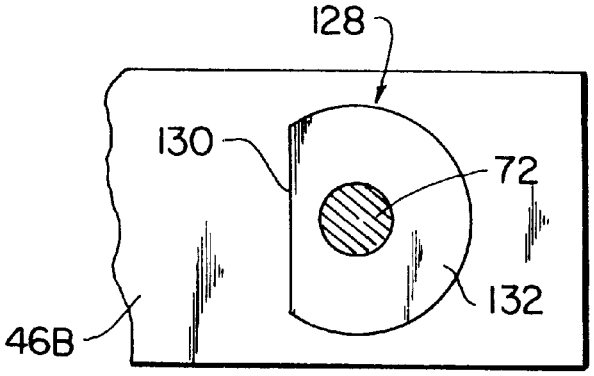
FIG. 8 is a sectional view taken along line VIII—VIII of FIG. 6.
Figure 9:
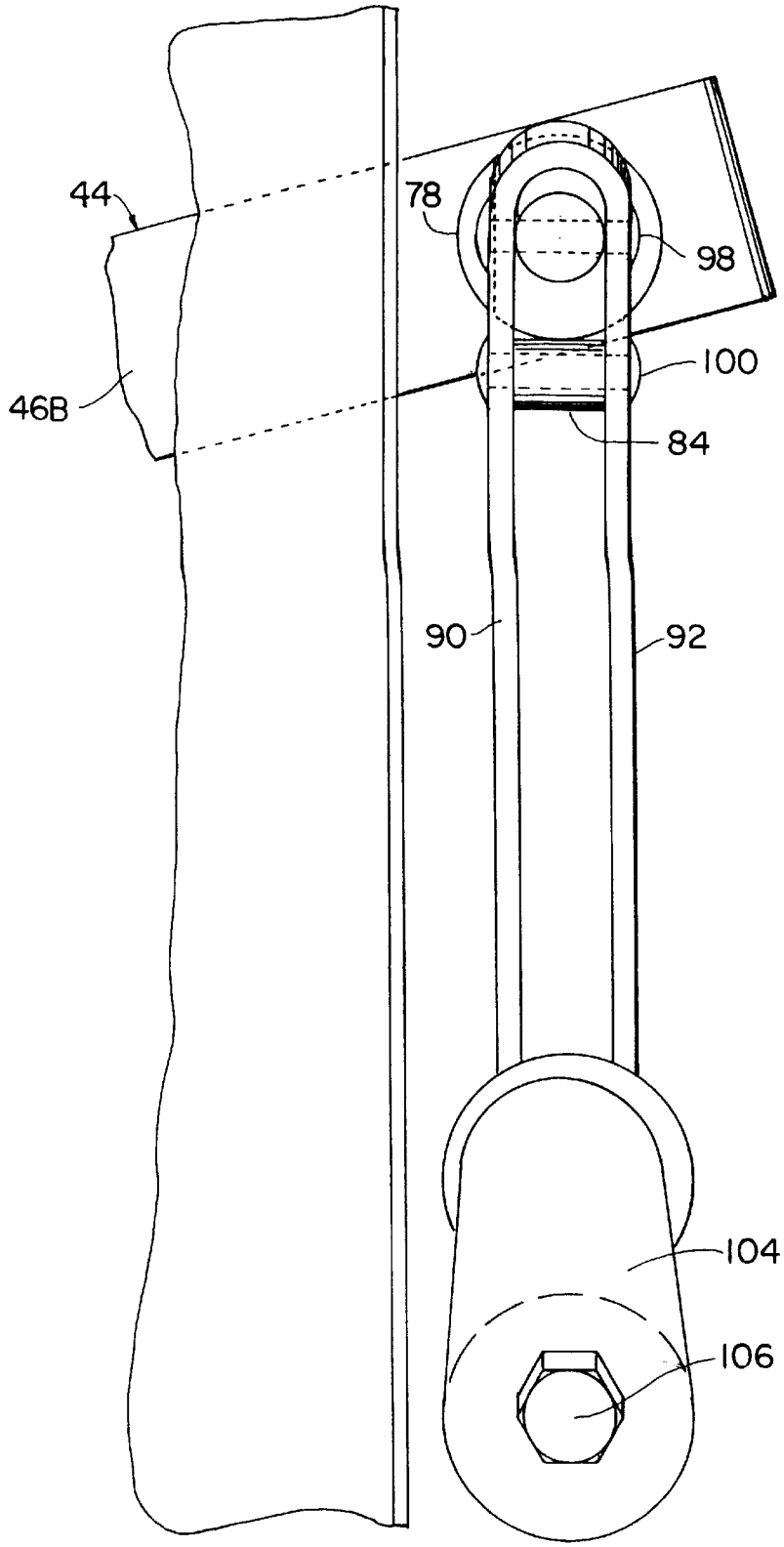
FIG. 9 is an elevational view of the handle assembly, shown in the non-rotatable position.

In addition to the safety feature described immediately above, the sleeve 78, at its end facing side plate 46B, is cut away as shown at 120 (FIG. 7) so as to form a chord-shaped projection or lug 122 (FIGS. 4, 7) having a flat side surface 124 and a flat end surface or face 126. Similarly, side plate 46B of yoke member 44 is provided with an annularly-shaped projection 128 that encircles rod 72, 74 and has a flat end face 132. Projection 128 is cut away at one side along a chord of its circumference so as to form a locking lug that is characterized by a flat side surface 130 that acts as a stop for lug 122 and a flat end face 132 (FIGS. 4, 8 and 9). Surface 130 is engageable by flat side surface 124 of lug 122, thereby providing a locking action that prevents rotation of sleeve 78, bar 84, and arm 88 on rod extension 74. Also in the lock position (FIG. 5), the nut 110 and the free end portion of arm 88 are blocked by frame member 12. It is to be noted that the mechanism is sized and designed so that when the handle is pulled out to cranking position, the flat end face 126 of projection 122 of sleeve 78 is spaced from the flat end surface 132 of projection 122, allowing sleeve 78 to rotate without interference from lug 128.

However, it is contemplated that the handle may be pulled out just enough for flat end surface 126 to make sliding contact with end surface 132 during the cranking operation.

To move the handle assembly 2 from the locked safety position (FIG. 5) to an unlocked position, an operator need only grasp the handle 104 and pull it outwardly away from yoke member 44, against the pressure of the coil spring 76, to the position shown in FIG. 6. Such movement of handle 104 and arm 88 does the following: (1) it causes bar 84 to pull sleeve 78 away from projection 128, so as to disengage surface 124 from surface 130 and so that end surface 122 will clear end surface 132; and (2) it moves the free (handle) end of arm 88 clear of the frame member 12 so as to permit handle assembly 2 to be cranked to rotate rod extension 74 and thereby rod 72 in a direction to lower the pump jack on pole 6.

In the event a problem develops, the operator need only release the handle 104, whereupon spring 76 will cause sleeve 78 to move toward yoke 44 far enough to allow re-engagement of end faces 126 and 132, with the result that with less than a single additional turn of crank arm 88 side surfaces 124 and 130 will be realigned, whereupon spring 76 will force sleeve 78 further toward the yoke 44, causing side surface 124 to re-engage side surface 130 so as to lock sleeve 78 against further rotation; and also moving the free end of arm 88 back into a blocked position where its handle end is blocked against rotation by frame member 12.

There is thus provided a handle assembly having two safety lock features, either of which is operable to prevent rotation of a pole-engaging rod, which safety features are deactivated by only very slight movements of the handle assembly, and in which activation requires only release of a handle grip member.

It will be understood that many additional changes in the details, materials, steps and arrangement of parts, which have been herein described and illustrated in order to explain the nature of the invention, may be made by those skilled in the art within the principles and scope of the invention as expressed in the appended claims. Thus, it is to be understood that the present invention is by no means limited to the particular construction herein disclosed and/or shown in the drawings, but also comprises any modifications or equivalents within the scope of the claims.

What is claimed is:

1. A handle assembly in combination with a pump jack having a shackle including a yoke with opposed side plates rotatably mounting a spanning rod engageable with a pump jack pole for rolling along a surface of the pole during descent of the pump jack along the pole, said handle assembly comprising:

an extension of the rod extending outwardly from one of the side plates, a free end of said rod extension being spaced from the one side plate;

a coil spring disposed around said rod extension;

a sleeve disposed around said rod extension and around said coil spring, a first end of said sleeve facing said one side plate and a second end of said sleeve facing outwardly from the one side plate;

a bar fixed to said sleeve and extending lengthwise thereof with a free end extending beyond said second end of said sleeve;

an arm extending transversely of said rod extension, said rod extension free end being pivotally connected to said arm at a first location proximate a first end of said arm, and said bar free end being pivotally connected to said arm at a second location proximate said first end of said arm and spaced from said first location in a direction toward a free end of said arm;

said coil spring urging said arm first end outwardly from the yoke, causing said bar to move inwardly toward the yoke, to urge said sleeve first end toward the yoke; and a projection extending outwardly from the one side plate and engageable by said sleeve first end, said projection and said sleeve first end being configured such that the engagement of said sleeve first end and said projection serves to interlock said sleeve and said projection such that said sleeve is prevented from rotating, whereby said rod extension is prevented from rotating and thereby said rod is fixed and unable to roll along the surface of the pole.

2. The handle assembly in accordance with claim 1 wherein said sleeve first end is provided with a locking surface, and said projection is provided with a locking surface complementary to said sleeve locking surface, said locking surfaces being engageable to prevent rotation of said sleeve relative to said projection.

3. The handle assembly in accordance with claim 1 wherein said sleeve is provided with an internal axially extending pocket, said pocket defining an annular shoulder in said sleeve, one end of said coil spring being seated on said shoulder.

4. The handle assembly in accordance with claim 3 wherein said pocket is open at said second end of said sleeve and said spring extends out of said sleeve second end and urges said arm first end outwardly.

5. The handle assembly in accordance with claim 1 and further comprising a handle mounted on said free end of said arm, and wherein said spring is operable to pivot said arm free end about said first and second locations to urge said arm free end in a direction toward the yoke into a position aligned with a frame member supporting the shackle, such that the frame member blocks rotational movement of said arm and said handle, and thereby said rod extension, to prevent the rod from rolling along the surface of the pole.

6. A handle assembly in combination with a pump jack having a shackle including a yoke with opposed side plates rotatably mounting a rod spanning the side plates and engageable with a pump jack pole for rolling along a surface of the pole during descent of the pump jack along the pole, said handle assembly comprising:

an extension of the rod extending outwardly from one of the side plates, a free end of said rod extension being spaced from the one side plate;

a coil spring disposed around said rod extension;

a sleeve disposed around said rod extension and around said coil spring, a first end of said sleeve being opposed to the one side plate and a second end of said sleeve facing outwardly from the one side plate;

a bar fixed to said sleeve and extending lengthwise thereof with a free end extending beyond said second end of said sleeve;

an arm extending transversely of said rod extension, said rod extension free end being pivotally connected to said arm at a first location proximate a first end of said arm, and said bar free end being pivotally connected to said arm at a second location proximate said first end of said arm and spaced from said first location in a direction toward a free end of said arm; and a handle mounted on said free end of said arm;

said spring being operative to pivot said arm about said first and second locations to urge said arm free end, and thereby said handle, in a direction toward the yoke and aligned with a frame member which supports the shackle and which blocks rotational movement of said arm and said handle, and thereby said rod extension, to prevent the rod from rolling along the surface of the pole.

7. The handle assembly in accordance with claim 6 wherein said sleeve is provided with a bore in which is disposed said rod, a portion of said bore being enlarged to form a shoulder in said bore to receive a first end of said coil spring, said enlarged portion of said sleeve bore being exposed at said sleeve second end, permitting said coil spring second end to extend out said second end of said sleeve toward said arm.

8. The handle assembly in accordance with claim 7 wherein said bar is fixed to an outside surface of said sleeve.

9. The handle assembly in accordance with claim 6 wherein pivotal movement of said arm outwardly about said first location causes movement of said arm to a position out of alignment with the frame member, such that said arm can be moved rotatably along with said rod extension to permit the rod to roll along the surface of the pole.

10. The handle assembly in accordance with claim 6 and further comprising a projection extending outwardly from the one side plate and engageable by said sleeve first end, said projection and said sleeve being configured such that engagement of said sleeve first end and said projection serves to interlock said sleeve and said projection, such that said sleeve is prevented from rotating, and said arm and said handle, and thereby said rod extension, are prevented from rotating, such that the rod is fixed and unable to roll along the surface of the pole.

11. The handle assembly in accordance with claim 2 wherein pivotal movement of said arm outwardly about said first location causes movement of said arm to a position out of alignment with the frame member, and moves said sleeve first end away from said projection, to permit the rod to rotate and to roll along the surface of the pole.

12. In combination with a pump jack having a shackle including a yoke with opposed side plates rotatably mounting a rod engageable with a pump jack pole for rolling along a surface of the pole during descent of the pump jack along the pole, a handle assembly comprising:

an extension of the rod extending outwardly from one of the side plates, a free end of said rod extension being spaced from the one side plate;

a coil spring disposed around said rod extension;

a sleeve disposed around said rod extension and around said coil spring, a first end of said sleeve being opposed to the one side plate and a second end of said sleeve facing outwardly from the one side plate;

a bar fixed to said sleeve and extending lengthwise thereof with a free end extending beyond said second end of said sleeve;

an arm extending transversely of said rod extension, said rod extension free end being pivotally connected to said arm at a first location proximate a first end of said arm, and said bar free end being pivotally connected to said arm at a second location proximate said first end of said arm and spaced from said first location in a direction toward a free end of said arm; and a handle mounted on said free end of said arm;

said coil spring urging said arm first end outwardly from the yoke, causing said bar to move inwardly toward the yoke, to urge said sleeve first end toward the yoke; and a projection extending outwardly from the one side plate and engageable by said sleeve first end, said projection and said sleeve first end being configured such that the engagement of said sleeve first end and said projection serves to interlock said sleeve and said projection such that said sleeve is prevented from rotating, and said rod extension is prevented from rotating, and such that the rod is fixed and unable to roll along the surface of the pole; and said spring being operative to urge said arm free end, and thereby said handle, in a direction toward the yoke and aligned with a frame member which supports the shackle and which blocks rotational movement of said arm and said handle, and thereby said rod extension, to prevent the rod from rolling along the surface of the pole.

13. The combination according to claim 4 wherein said sleeve is provided with an axially extending pocket defining an interior annular shoulder on which is seated a first end of said spring.

14. The combination according to claim 13 wherein said pocket is open at said second end of said sleeve, and a second end of said spring extends out of said second end of said sleeve.

15. The combination according to claim 6 and further comprising a washer mounted on said rod extension between said spring second end and said arm first end, such that said spring second end bears against said washer, and said washer bears against said arm first end.

16. The combination according to claim 4 wherein said sleeve first end is provided with a wall extending therefrom, and the one side plate is provided with an annular protrusion extending towards said sleeve, said protrusion being provided with a wall extending therefrom complementary to said sleeve wall, said walls being engageable with one another to lock said sleeve to said projection to prevent rotation of said sleeve, and thereby said rod extension and the rod.

17. The combination according to claim 4 wherein said arm comprises a U-shaped member having elongated parallel arm portions fixed at their free ends to an elongated nut, said nut and arm free end portion being urged by said spring into a position in which said nut and said arm free end portion are blocked by the frame member from rotational movement.

18. A pump jack for use with a jack pole, said pump jack comprising upper and lower shackle assemblies with each shackle assembly having front and rear pole-gripping members, with the front pole-gripping member of said upper shackle assembly being rotatably supported by opposed side members of said upper shackle assembly and being coupled to a handle assembly for rotating it in a direction to lower the jack on said pole, a foot pump operatively coupled to said upper shackle assembly for causing said upper and lower shackle assemblies to alternatively grip and release a pump jack pole that is embraced by said shackle assemblies, and selectively operable means for moving said lower shackle assembly to a pole releasing position, said handle assembly comprising a rod forming an axial extension of said front pole-gripping member of said upper shackle assembly, an arm having first and second opposite ends, means forming a first pivot connection between said first end of said arm and a free end of said rod, said arm being movable via said pivot connection between a first locking position and a second cranking position, a sleeve surrounding and slidable lengthwise on said rod, a handle member attached to said second end of said arm, said handle member projecting laterally from said arm so that it can be used to crank said arm to rotate said rod when said arm is in said second cranking position, a connecting member fixed to said sleeve, means forming a second pivot connection between said connecting member and said arm, so that pivotal movement of said arm from said first locking position to said second cranking position will cause said sleeve to move axially on said rod away from said opposed side members of said upper shackle assembly and pivotal movement of said arm from said second cranking position to said first locking position will cause said sleeve to move axially on said rod toward said opposed side members of said upper shackle assembly; a spring surrounding said rod and acting between said arm and said sleeve to move said sleeve toward said opposed side members, and first and second means on said sleeve and one of said opposed side members for locking said sleeve and said rod against rotation when said arm is in said first locking position.

* * * * *